US005087382A

United States Patent [19]

Ishino et al.

[11] Patent Number: 5,087,382

[45] Date of Patent: Feb. 11, 1992

[54] ELECTROVISCOUS FLUID

[75] Inventors: Yuichi Ishino, Fuchu; Toshiyuki Osaki, Higashimurayama; Shigeki Endo, Kodaira; Seisuke Tomita, Tokorozawa; Takayuki Maruyama; Yoshiki Fukuyama, both of Kodaira; Tasuku Saito, Tokorozawa, all of Japan

[73] Assignee: Bridgestone Corporation, Tokyo, Japan

[21] Appl. No.: 400,134

[22] Filed: Aug. 29, 1989

[30] Foreign Application Priority Data

| | | | |
|---|---|---|---|
| Aug. 29, 1988 | [JP] | Japan | 63-212615 |
| Dec. 23, 1988 | [JP] | Japan | 63-323569 |
| Apr. 6, 1989 | [JP] | Japan | 1-85783 |

[51] Int. Cl.[5] ..... C10M 125/02; C09K 3/00

[52] U.S. Cl. ..... 252/73; 252/572

[58] Field of Search ..... 252/73, 572

[56] References Cited

U.S. PATENT DOCUMENTS

| | | | |
|---|---|---|---|
| 2,417,850 | 3/1947 | Windlow | 252/572 |
| 3,047,507 | 7/1962 | Winslow | 252/75 |

FOREIGN PATENT DOCUMENTS

| | | |
|---|---|---|
| 63-97694 | 4/1988 | Japan . |
| 63-323569 | 12/1988 | Japan . |
| 64-6093 | 1/1989 | Japan . |

OTHER PUBLICATIONS

Carbon vol. 3, Jun. 1965, pp. 185-193, Pergamon Press Ltd. GB; J. D. Brooks et al.: "The formation of graphitizing carbons from the liquid phase" Abstract; pp. 185-186.

Patent Abstracts of Japan, vol. 12, No. 338 (C-527) (3185) Sep. 12, 1988, p. 82 C 527; & JP-A-63 97 694 (Asahi Chem. Ind. Co. Ltd) 28-04-1988.

Patent Abstracts of Japan, vol. 13, No. 179 (C-590) (3527) Apr. 26, 10-01-1989 *Abstract*.

"International Committee for Characterization and Terminology of Carbon 'First Publication of Further 24 Tentative Definitions'", Carbon vol. 21, No. 5, pp. 517-519, 1983, Great Britain.

"International Cooperation on Characterization and Nomenclature of Carbon and Graphite", Carbon, 1975, vol. 13, pp. 251-253, Pergamon Press, Great Britain.

Proceedings First International Symposium on Electrorheological Fluids, "Edited by Conrad et al., Paper 1, Materials and Mechanisms in Electro-Rheology", Block et al., pp. 1, 4, 12.

*Primary Examiner*—Paul Lieberman

*Assistant Examiner*—Christine A. Skane

*Attorney, Agent, or Firm*—Cushman, Darby & Cushman

[57] ABSTRACT

The electroviscous fluid is a suspension composed of a finely divided dielectric solid dispersed in an electrically nonconductive oil. The viscosity of the fluid increases swiftly and reversibly under an influence of electric field applied thereto and the fluid turns to a state of plastic or solid when the influence is sufficiently strong.

The electroviscous fluid of the present invention comprises 1-60% by weight of a dispersed phase of carbonaceous particulates having average particle size of 0.01-100 micrometer, and 99-40% by weight of a continuous liquid phase of an electric insulating oil having a viscosity of 0.65-500 centistokes at room temperature.

The electroviscous fluid exhibits an excellent electroviscous effect even at a high temperature with a low electric power consumption together with maintaining the improved electroviscous effect for a long period of time.

14 Claims, 3 Drawing Sheets

ELECTROVISCOUS FLUID

FIELD OF THE INVENTION

The present invention relates to an electroviscous fluid which increases its viscosity when an electric potential difference is applied thereto.

DESCRIPTION OF THE PRIOR ART

The electroviscous fluid is a suspension composed of a finely divided dielectric solid dispersed in an electrically nonconductive oil. The viscosity of the fluid increases swiftly and reversibly under an influence of electric field applied thereto and the fluid turns to a state of plastic or solid when the influence is sufficiently strong.

An electric field to be applied for changing the viscosity of the fluid can be not only that of a direct current but also that of an alternating current, and the electric power requirement is very small to make it possible to give a wide range of viscosity variation from liquid state to almost solid state with a small consumption of electric power.

The electroviscous fluid has been studied with an expectation that it can be a system component to control such apparatus or parts as a crutch, a valve, a shock absorber, a vibrator, a vibration-isolating rubber, an actuator, a robot arm, a damper, for example.

Hitherto, electroviscous fluids using such solid particulates as cellulose, starch, silica gel, ion exchange resin and lithium polyacrylate which have been absorbed water from the surface and pulverized (U.S. Pat. Nos. 2,417,850, 3,047,507, 3,397,147, 3,970,573, and 4,129,513, Japanese Patent Publication Tokkosho No. 60-31211 and DT-OS No. 3,427,499) as one component and using such liquid as diphenylhalide, dibutyl sebacate, hydrocarbon oils, chlorinated paraffin and silicone oils as the other component were proposed.

However, they are not satisfactory in practical usages, and an electroviscous fluid practically usable with excellent performance and stability has not been known.

Characteristics requested for an electroviscous fluid usable practically are exhibiting an enhanced electroviscous effect covering a wide range of temperature, a small electric power consumption for imposing electric field, a low viscosity when electric field is removed and long term stability without the deposition of the dispersed particulates.

However, those dispersed particulates containing water to attain the enhanced electroviscous effect have a problem of much electric current through the particulates which results in an excessive consumption of electric power. The tendency is enhanced especially with the increase of the temperature, and the upper limit of the temperature at which the conventional electroviscous fluids using such dispersed phases can be used practically is said to be around 70–80° C. When the electroviscous fluid is used at temperatures higher than the limit, a large consumption of electric power is required due to the excessive flow of electric current as well as a decreased performance and delayed response of the electroviscous effect as the time proceeds. Accordingly, it was impossible to use the electroviscous fluid as constituents operated under such a high temperature circumstances.

Furthermore, the electroviscous fluids using the particulates containing water for the purpose of enhancing the electroviscous effect do not show the electroviscous effect at temperatures under 0° C., because the water freezes at temperatures under 0° C.

As explained above, the conventional electroviscous fluids using the particulates containing water as the dispersed phase for the purpose of enhancing the electroviscous effect have a essential defect that the temperature range for use is limited and the problem of limited lifetime due to the evaporation of water.

From the above mentioned reasons, there has been desired the development of an electroviscous fluid using anhydrous solid particulates as the dispersed phase which is expected to be capable of showing a higher electroviscous effect at high temperatures with a lessened electric power consumption together for a long period of time.

U.S. Pat. No. 4,678,589, Japanese Patent Provisional Publication Tokkaisho No. 63-97694 and Japanese Patent Provisional Publication Tokkaisho No. 64-6093 proposed an electroviscous fluid containing no water or an electroviscous fluid using particulates with multi. layer structure as the dispersed phase. However, there are still problems in them such as a smaller electroviscous effect, larger consumption of electric power, or the problem that it can be used only under the alternating electric current.

The mechanism of the electroviscous effect in anhydrous system is supposed that the application of an electric potential difference induces interfacial polarization due to the movement of electrons in each particulate, the mutual attraction among the electronically polarized particulates, the formation of bridges among the particulates and elevation of viscosity of the fluid dispersing such particulates therein.

Based on this viewpoint, the inventors of the present invention paid attention to an low temperature treated carbonaceous material which has a high concentration of stable radical (unpaired electron), and examined the availability for the dispersed phase of an electroviscous fluid, and developed an electroviscous fluid showing a high electroviscous effect with smaller electric power consumption in a wide range of temperatures under the application of a direct current or an alternating current.

SUMMARY OF THE INVENTION

The primary object of the present invention is to provide an electroviscous fluid which uses anhydrous solid particulates as the dispersed phase and can exhibit a greater electroviscous effect with less electric power consumption in a wide range of temperatures and can be used for a long period of time.

The electroviscous fluid of the present invention comprises: 1–60% by weight of a dispersed phase of carbonaceous particulates having average particle size of 0.01–100 micrometer, and 99–40% by weight of a continuous liquid phase of an electric insulating oil having a viscosity of 0.65–500 centistokes at room temperature.

DETAILED DESCRIPTION OF THE PREFERRED EMBODIMENTS

Figure 1:
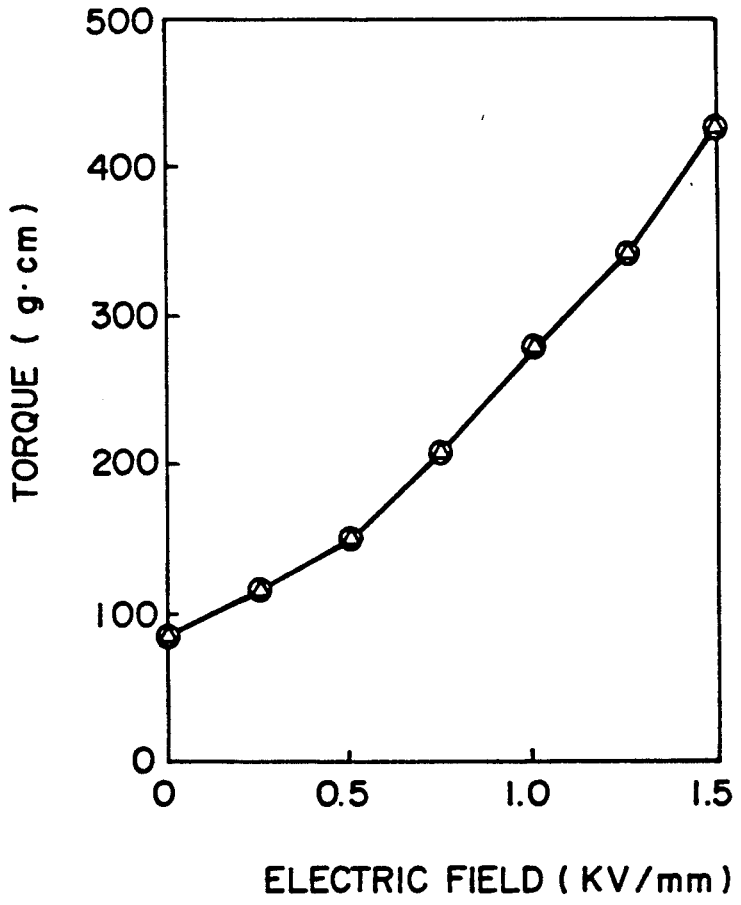
FIG. 1 is a graph showing the relationship between the magnitude of electric field (abscissa: KV/mm) and torque (ordinate: g·cm) for the electroviscous fluid of Example 1 before (◯ mark) and after (Δ mark) subjecting it to a high temperature heat-treatment at 120° C. for 50 hours.

The present invention is directed to provide an electroviscous fluid capable of exhibiting an excellent electroviscous effect even at a high temperature with a low electric power consumption together with maintaining the improved electroviscous effect for a long period of time.

The problem has been solved through an electroviscous fluid comprising 1-60% by weight of a dispersed phase of carbonaceous particulates having average particle size of 0.01-100 micrometer, and 99-40% by weight of a continuous liquid phase of an electric insulating oil having a viscosity of 0.65-500 centistokes at room temperature.

In the present invention, the carbonaceous particulates suitable for the dispersed phase of the electroviscous fluid is to have a carbon content of 80-97 % by weight, more preferably 90-95% by weight, the C/H ratio (atomic ratio of carbon/hydrogen) of 1.2- 5, preferably 2-4, and the average particle size 0.01-100 micrometer.

It is well known that the electric resistance of particulates generally used as the dispersed phase of electroviscous fluid is in the area of semiconductor [Winslow: J. Appl. Physics 20 1137 (1949)] Carbonaceous particulates having the carbon content of under 80% by weight and the C/H ratio of under 1.2 are insulating material and do not show the electroviscous effect when applied as the dispersed phase.

On the other hand, carbonaceous particulates having the carbon content of over 97% by weight and the C/H ratio of over 5.0 show a nearly equal property as that of an conductor and an excessive electric current flows when an electric potential difference is applied thereon thus giving no practically usable electroviscous fluid.

Practically, carbonaceous particulates which are preferably used as the dispersed phase in the electroviscous fluid of the present invention include the so-called low temperature treated carbonaceous particulates such as; pulverized particulates of coal tar pitch, petroleum pitch and a pitch obtained by thermal decomposition of polyvinylchloride; particulates composed of various carbonaceous mesophases obtained by heat treatment of raw pitches or tar components, that is, particulates obtained by a solvent removal of pitch component from the pitch containing optical anisotropic spherules (mesophase spherules) obtained by above mentioned heat treatment; particulates obtained by pulverization of above mentioned various carbonaceous mesophase spherules; particulates obtained by heat treatment of raw pitches to be converted to bulk-mesophases (Japanese Patent Provisional Publication Tokkaisho 59-30887) and then pulverized; particulates obtained by pulverization of partially crystallized pitch; particulates obtained by low temperature carbonization of thermosetting resin such as phenolic resin; particulates comprising pyrolized polyacrylonitrile. In addition to the above, particulates obtained by pulverization of anthracite, bituminous coal and the like; carbonaceous particulates obtained by heating under pressure a mixture of vinyl hydrocarbon polymers such as polyethylene, polypropylene or polystyrene with chlorine-containing polymers such as polyvinylchloride or polyvinylidenechloride, and pulverized products of thus obtained carbonaceous particulates are preferably used.

In order to obtain a high electroviscous effect with less electric power consumption, those carbonaceous particulates having a high aromatic spin radical concentration of $10^{18}$/g or more and a high volume resistivity of $10^5\Omega$·cm or more are preferable.

From this standpoint, the carbonaceous particulates obtained by heat treatment of coal tar pitch to produce optically anisotropic spherules (mesophase spherules) followed by removing pitch component therefrom are most preferable among the above mentioned carbonaceous particulates.

An outlined process for preparing such carbonaceous particulates from coal tar pitch is described hereunder. Coal tar pitch is heat-treated at 350-500° C. to allow optically anisotropic spherules of spherical shape (mesophase spherules) come to grow [J. D. Brooks and G. H. Taylor; Carbon 3, 185 (1965)]. Since the size of mesophase spherule depends on the heating temperature and length of heating time, terminate the heating at a stage when the mesophase spherule grow to a size desired. The mesophase spherule is separated therefrom by dissolving remained coal tar pitch with a solvent and filtering off.

The mesophase spherule has a structure similar to liquid crystal, and is a spherical carbonaceous particulate. A part of coal tar pitch component (e.g. β-resin), which vaporized at the temperature of 400-600° C. in an inert gas, tends to remain on the surface of mesophase spherule when it is separated as described in (Japanese Patent Provisional Publication Tokkaisho No. 60-25364), but the pitch component can be removed, if necessary, by heat-treating it at 200-600° C. under an inert gas atmosphere, which improves the electric resistance and aromatic spin radical concentration of the mesophase spherule.

The particle size of mesophase spherule is controlled by adjusting the length of heating time and heating temperature of the coal tar pitch, and the size can be reduced by pulverization.

As to the raw material other than coal tar pitch, petroleum pitches having similar structures can be treated in the same manner to produce carbonaceous particulates suitable for usage in the present invention.

The water content in those carbonaceous particulates are less than 1% by weight and gives no influence to the electroviscous effect. It is supposed that the high aromatic spin radical concentration of the carbonaceous particulates induces interfacial polarization of the particulates to give the electroviscous effect. Accordingly, using such carbonaceous particulates as the dispersed phase, an electroviscous fluid exhibiting a high electroviscous effect in a wide temperature range for a long period time can be obtained.

As the above mentioned carbonaceous particulates composed of mesophase spherule have an optical anisotropy, they show anisotropy in the electric conductivity too and supposed to be the reason that the electroviscous fluid using such carbonaceous particulates as the dispersed phase show a low electric power consumption.

The C/H ratio of the carbonaceous particulates varies in accordance with the heat treating temperature and the electric conductivity of the particulates varies accordingly. With the increase of the C/H ratio, the electroviscous effect increases together with the electric power consumption. Therefore, it is necessary to set the value of electric resistance of the carbonaceous particulates to give a proper balance of the electroviscous effect and the electric power consumption. From this standpoint, the most preferable value of the volume resistivity of the carbonaceous particulates is in the range of $10^7$–$10^{10}\Omega$·cm.

Further, it has been found that it is effective to coat the surface of the above mentioned carbonaceous particulates with an electric insulating thin layer partly or wholly in order to obtain a high level electroviscous effect with less electric power consumption.

As the electric insulating thin layer, it is desirable to form a thin layer of organic or inorganic insulating material on the surface of the carbonaceous particulates with a thickness of less than one tenth of the diameter of the particulate.

The most preferable thickness of the thin layer is decided depending on the electric conductivity of the carbonaceous particulate. When the electric conductivity of the carbonaceous particulate is comparatively higher, a comparatively thicker layer is recommended. On the contrary, when the electric conductivity of the carbonaceous particulate is comparatively lower, a comparatively thinner layer is recommended in order to maintain a high level electroviscous effect with less electric power consumption.

Such electric insulating thin layer can be formed on the surface of the carbonaceous particulates with methods such as; coating of a solution of high molecular weight compound on the particulates; the hybridization method wherein micro particles of electric insulating material are mixed with the carbonaceous particulates by dry method and melted on the surface of the carbonaceous particulates; surface treatments of the carbonaceous particulates such as the silane treatment; vacuum deposition by sputtering; polymerization of monomer on the surface of the carbonaceous particulates.

The preferable value of the volume resistivity of the electric insulating layer is $10^{10}\Omega$·cm or more.

As to the electric insulating material, synthetic high molecular weight materials such as polymethylmethacrylate, polystyrene, polyvinylacetate, polyvinylchloride, polyvinylidenefluoride, epoxy resin, phenol resin, melamine resin; silane coupling agents such as methyltrimethoxysilane, phenyltrimethoxysilane, hexamethyldisilazane, trimethylchlorosilane; modified silicone oils having a main chain of dimethylpolysiloxane or phenylmethylpolysiloxane structure and carboxyl group or hydroxyl group; and inorganic compounds such as silica, alumina, rutile are mentioned.

By the use of such carbonaceous particulates coated with electric insulating thin layer as the dispersed phase, an electroviscous fluid having a high electroviscous effect with less electric power consumption can be obtained.

The particle size suitable for the dispersed phase of the electroviscous fluid is in the range of 0.01–100 micrometer, preferably in the range of 0.1–20 micrometer, and more preferably in the range of 0.5–5 micrometer. When the size is smaller than 0.01 micrometer, initial viscosity of the fluid under no imposition of electric field becomes extremely large and the change in viscosity due to the electroviscous effect is small. When the size is over 100 micrometer, the dispersed phase can not be held sufficiently stable in the liquid.

As the electric insulating oil to constitute the liquid phase of an electroviscous fluid, oils having a volume resistivity of $10^{11}\Omega$·cm or more, especially having a volume resistivity of $10^{13}\Omega$·cm or more are preferable. For example, hydrocarbon oils, ester oils, aromatic oils, halogenated hydrocarbon oils such as perfluoropolyether and polytrifluoromonochloroethylene, phosphazene oils and silicone oils are mentioned. They may be used alone or in a combination of more than two kinds. Among these oils, such silicone oils as polydimethylsiloxane, polymethylphenylsiloxane and polymethyltrifluropropylsiloxane are preferred, since they can be used in direct contact with materials such as rubber and various kinds of polymers.

The desirable viscosity of the insulating oil is in the range of 0.65–500 centistokes (cSt) at 25° C., preferably in the range of 5–200 cSt, and more preferably in the range of 5–50 cSt. When the viscosity of the liquid phase is too small, stability of the liquid phase becomes inferior due to an increased content of volatile matters, and a too high viscosity of the liquid brings about an heightened initial viscosity under no imposition of electric field to result in a decreased changing range of viscosity by the electroviscous effect. When an electric insulating oil having an appropriate low viscosity is employed as the liquid phase, the liquid phase can suspend a dispersed phase efficiently.

With regard to the ratio of the dispersed phase to the liquid phase constituting the electroviscous fluid according to the present invention, the content of the dispersed phase composed of the aforementioned carbonaceous particulates is 1–60% by weight, preferably 20–50% by weight, and the content of the liquid phase composed of the aforementioned electrical insulating oils is 99–40% by weight, preferably 80–50% by weight. When the dispersed phase is less than 1% by weight, the electroviscous effect is too small, and when the content is over 60% an extremely large initial viscosity under no imposition of electric field appears.

It may be possible to incorporate or compound water and other additives including surface active agents, dispersing agents, antioxidant and stabilizing agent into the electroviscous fluid of the present invention being within a range not deteriorating the effects of the present invention.

The present invention will be illustrated with Examples hereinafter.

EXAMPLE 1

A coal tar pitch was heat treated at 450° C. in an inert gas (nitrogen) to make grow mesophase spherule in it, then the remaining pitch component was removed by repeated extractions with a tar middle oil and filtrations. Then the filter cake was calcined at 350° C. in an inert gas (nitrogen) to obtain carbonaceous particulates composed of mesophase spherule. The assay was carbon content: 93.78% by weight, C/H ratio: 2.35, electric resistance $1.79\times10^9\Omega$·cm, electron spin concentration: $3.28\times10^{19}$/g, and water content: 0.4% by weight. The carbonaceous particulates were sieved to obtain particulates having an average particle size of 14 micrometer. The carbonaceous particulates being 40% by weight were dispersed in a liquid phase component being 60% by weight of a silicone oil (Toshiba-Silicone co.: TSF 451-20 ®) having 20 cSt viscosity at 25° C. to prepare an electroviscous fluid in a suspension form.

EXAMPLE 2

Carbonaceous particulates composed of mesophase spherule were prepared by the same method with that of Example 1 except that the calcination was done at 450° C. Characteristics of the particulates are shown in Table 1. The carbonaceous particulates were sieved to obtain particulates having an average particle size of 16 micrometer. The carbonaceous particulates being 40% by weight were dispersed in a liquid phase component being 60% by weight of a silicone oil (Toshiba-Silicone co.: TSF 451-20 ®) having 20 cSt viscosity at 25° C. to prepare an electroviscous fluid in a suspension form.

EXAMPLE 3

Carbonaceous particulates composed of mesophase spherule prepared by the same method with that of Example 2 were pulverized with a jet mill and sieved to obtain carbonaceous particulates having an average particle size of 4 micrometer. The carbonaceous particulates being 40% by weight were dispersed in a liquid phase component being 60% by weight of a silicone oil (Toshiba-Silicone co.:TSF 451-20 ®) having 20 cSt viscosity at 25° C. to prepare an electroviscous fluid in a suspension form.

EXAMPLE 4

Carbonaceous particulates composed of mesophase spherule were prepared by the same method with that of Example 1 except that the calcination was done at 200° C. Characteristics of the particulates are shown in Table 1. Using the particulates, an electroviscous fluid in a suspension form was prepared in the same manner as that of Example 1.

EXAMPLE 5

Carbonaceous particulates composed of mesophase spherule were prepared by the same method with that of Example 1 except that the calcination was done at 500° C. Characteristics of the particulates are shown in Table 1. Using the particulates, an electroviscous fluid in a suspension form was prepared in the same manner as that of Example 1.

EXAMPLE 6

Carbonaceous particulates composed of mesophase spherule were prepared by the same method with that of Example 1 except that the calcination was done at 600° C. Characteristics of the particulates are shown in Table 1. Using the particulates, an electroviscous fluid in a suspension form was prepared in the same manner as that of Example 1.

EXAMPLE 7

The same carbonaceous particulates as used in Example 2 were treated with xylene solution of phenyltrimethoxysilane under reflux at 80° C. for 6 hours, then sieved to obtain surface-coated particulates. The surface-coated carbonaceous particulates being 40% by weight were dispersed in a liquid phase component being 60% by weight of a silicone oil (Toshiba Silicone co.:TSF 451-20 ®) having 20 cSt viscosity at 25° C. to prepare an electroviscous fluid in a suspension form.

EXAMPLE 8

The same carbonaceous particulates as used in Example 6 were treated with xylene solution of methyltrimethoxysilane under reflux at 80° C. for 6 hours, then sieved to obtain surface-coated particulates. The surface-coated carbonaceous particulates being 40% by weight were dispersed in a liquid phase component being 60% by weight of a silicone oil (Toshiba Silicone co.: TSF 451-20 ®) having 20 cSt viscosity at 25° C. to prepare an electroviscous fluid in a suspension form.

EXAMPLE 9

Commercially available microbeads of phenolic resin were calcined at 600° C. in nitrogen gas to obtain carbonaceous particulates having an average particle size of 8 micrometer. Characteristics of the particulates are shown in Table 1. Using the particulates, an electroviscous fluid in a suspension form was prepared in the same manner as that of Example 1.

EXAMPLE 10

40% by weight of the same carbonaceous particulates as used in Example 2 were dispersed in a liquid phase component composed of 40% by weight of polytrifluoro-monochloroethylene having 10 cSt viscosity at 25° C. and 20% by weight of naphthenic hydrocarbon oil having 5.2 cSt viscosity at 25° C. to prepare an electroviscous fluid in a suspension form.

COMPARATIVE EXAMPLE 1

40% by weight of commercially available sodium polyacrylate powder was dispersed in 60% by weight of the silicone oil as used in Example 1 to prepare an electroviscous fluid. Characteristics of the sodium polyacrylate powder are shown in Table 1.

COMPARATIVE EXAMPLE 2

13% by weight of a fine powder of silica-gel (Nippon Silica Co.: NIPSIL VN-3 ®) was dispersed in 87% by weight of the silicone oil as used in Example 1 to prepare an electroviscous fluid. Characteristics of the silica-gel are shown in Table 1.

In Table 1, the carbon content (weight percent) and the C/H ratio (the atomic ratio of carbon to hydrogen) were obtained from elemental analysis. The concentration of aromatic radical are represented by the electron spin concentration. The electron spin concentration was measured by comparing the peak strength at half band width of under 1 mT with a known concentration standard, using ESR (electron spin resonance) apparatus in conditions of magnetic flux density at center part: 331 mT (millitesra), frequency of microwave: 9.233 GHz (gigahertz). The electric resistance was measured for pressure compacted powder. The water content was measured from volatile loss at 250° C. by Karl-Fisher method.

TABLE 1

| | Carbon content wt. % | C/H ratio | Electron Spin conc./g | Volume resistivity Ω · cm | Water content wt. % | Particle size μ |
|---|---|---|---|---|---|---|
| Example 1 | 93.78 | 2.35 | $3.28 \times 10^{19}$ | $1.79 \times 10^{9}$ | 0.4 | 14 |
| Example 2 | 93.4 | 2.44 | $4.36 \times 10^{19}$ | $4.73 \times 10^{8}$ | 0.3 | 16 |
| Example 4 | 92.3 | 1.59 | $2.39 \times 10^{19}$ | $7.34 \times 10^{9}$ | 0.4 | 19 |

TABLE 1-continued

| | Carbon content wt. % | C/H ratio | Electron Spin conc./g | Volume resistivity Ω · cm | Water content wt. % | Particle size μ |
|---|---|---|---|---|---|---|
| Example 5 | 94.1 | 2.54 | $7.12 \times 10^{19}$ | $6.55 \times 10^{7}$ | 0.5 | 16 |
| Example 6 | 94.4 | 3.10 | $3.93 \times 10^{19}$ | $4.50 \times 10^{5}$ | 0.8 | 19 |
| Example 9 | 91.4 | 2.70 | $0.63 \times 10^{19}$ | $7.50 \times 10^{8}$ | 0.9 | 8 |
| Comp. Ex. 1 | — | — | trace | $3.22 \times 10^{9}$ | 9.5 | 10 |
| Comp. Ex. 2 | — | — | not detected | $4.2 \times 10^{6}$ | 6.7 | 0.016 |

Each of the electroviscous fluids prepared in Examples 1-10 and Comparative Examples 1-2 were subjected to measurements of the electroviscous effect. The electroviscous effect was measured with a double-cylinder type rotary viscometer to which a direct current was applied with an electric potential difference between the outer and inner cylinder, and the effect was evaluated with shearing force under the same shearing speed (375 $sec^{-1}$) at 25° or 80° C., together with measurement of electric current density between the inner and outer cylinders. (radius of inner cylinder: 34 mm, radius of outer cylinder: 36 mm, height of inner cylinder: 20 mm)

In Table 2, To is the shearing force under no application of electric potential difference, T is the shearing force under application of electric potential difference of 2 KV/mm, T-To is the difference of T and To and the current density is the value under application of electric potential difference of 2KV/mm.

The value of T-To indicates the magnitude of electroviscous effect of the fluid. That is, a fluid showing a large T-To in Table 2 exhibits an enhanced electroviscous effect. And the value of the current density ($\mu A/cm^2$) concerns an electric power required to apply the electric potential difference (2 KV/mm).

naceous particulates without surface coating. In the same manner, the Example 8 using surface coated carbonaceous particulates show about the same electroviscous effect with one forth of electric current compared the Example 6 using the same carbonaceous particulates without surface coating.

The carbonaceous particulates obtained by calcination of a thermosetting resin used in the Example 9 showed the electroviscous effect in the same manner as the carbonaceous mesophase spherules, thus indicating the characteristics of nonaqueous system having a high electron spin concentration.

On the contrary, the silica used in the Comparative Example 2 showed no electron spin concentration as can be seen in Table 1, thus proving that the electroviscous fluid of the Comparative Example 2 is an aqueous system electroviscous fluid, though it showed the electroviscous effect as can be seen in Table 2.

When an alternating current with electric potential difference of 2 KV/mm was applied to the electroviscous fluid of the Example 1, the value of T at 25° C. was 522 g·cm and the current density was 66 $\mu A/cm^2$. The results indicate that the electroviscous fluid using the carbonaceous particulate as the dispersed phase can act with alternating current, though the electroviscous

TABLE 2

| | 25° C. | | | Current | 80° C. | | | Current |
|---|---|---|---|---|---|---|---|---|
| | To g · cm | T g · cm | T − To g · cm | Density $\mu A/cm^2$ | To g · cm | T g · cm | T − To g · cm | Density $\mu A/cm^2$ |
| Example 1 | 85 | 621 | 536 | 10.00 | 53 | 534 | 481 | 20.00 |
| Example 2 | 67 | 699 | 632 | 49.90 | 44 | 1017 | 973 | 110.00 |
| Example 3 | 154 | 913 | 759 | 20.40 | | | | |
| Example 4 | 75 | 292 | 217 | 3.20 | 49 | 339 | 290 | 9.30 |
| Example 5 | 76 | 946 | 870 | 130.30 | | | | |
| Example 6 | 76 | 1050 | 974 | 4183.70 | | | | |
| Example 7 | 80 | 698 | 618 | 26.10 | | | | |
| Example 8 | 95 | 999 | 904 | 1074.80 | | | | |
| Example 9 | 81 | 205 | 124 | 0.90 | | | | |
| Example 10 | 110 | 985 | 875 | 29.70 | | | | |
| Comp. Ex. 1 | 169 | 402 | 233 | 0.30 | 79 | 825 | 746 | 266.00 |
| Comp. Ex. 2 | 250 | 403 | 153 | 7.90 | | | | |

It is noticeable that the electroviscous fluids of the Examples 1, 2 and 4 using carbonaceous particulates with little water content show enough electroviscous effect under a high temperature condition (80° C.) with a small increase of electric current compared to the case under normal temperature (25° C.), whereas the Comparative Example 1 using particulates with high water content show a tremendous increase of electric current under a high temperature condition (80° C.) compared to the case under normal temperature (25° C.). Especially, the Example 2 show a higher electroviscous effect with a smaller electric current compared to the Comparative Example 1 at 80° C.

Viewing the data at 25° C., the Example 7 using surface coated carbonaceous particulates show the same electroviscous effect with about a half of electric current compared to the Example 2 using the same carboeffect therefrom was a little smaller than the case applying the direct current.

Figure 2:
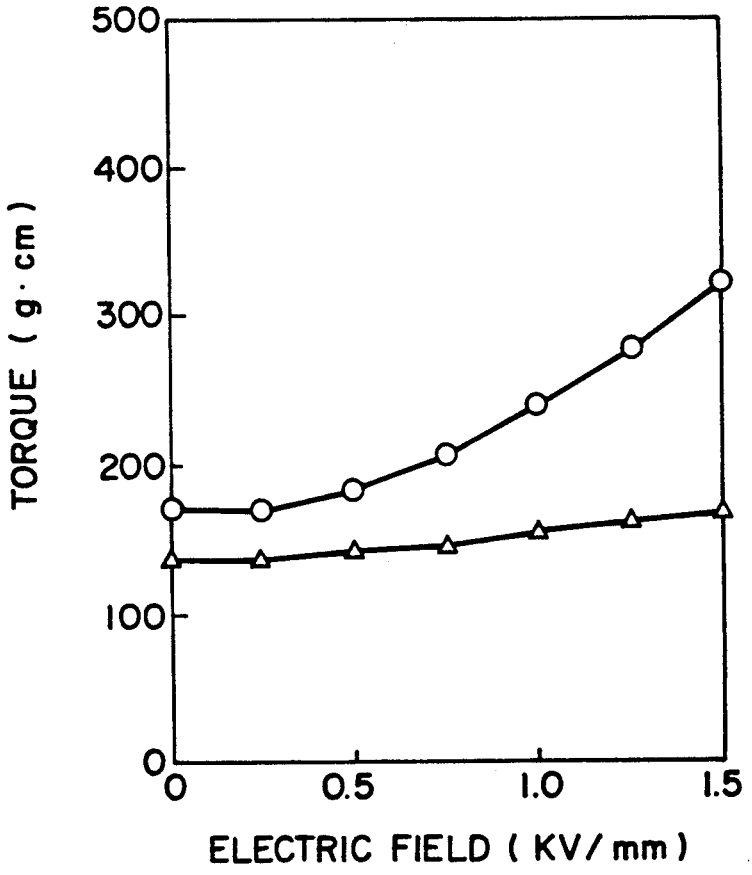
FIG. 2 is a graph showing the result of the same measurement for the electroviscous fluid of Comparative Example 1.

FIG. 1 is a graph showing the relationship between the magnitude of electric field (abscissa: KV/mm) and torque (ordinate: g·cm) for the electroviscous fluid of Example 1 before (○ mark) and after (Δ mark) subjecting it to a high temperature heat-treatment at 150° C. for 50 hours. FIG. 2 is a graph showing the result of the same measurement for the electroviscous fluid of Comparative Example 1.

As can be seen from FIG. 1, the electroviscous fluid of Example 1 shows no change for the electroviscous effect even after a continuous high temperature treatment. Whereas the electroviscous fluid of Comparative Example 1 show a decrease in the electroviscous effect after the high temperature treatment as can be seen in FIG. 2.

Figure 3:
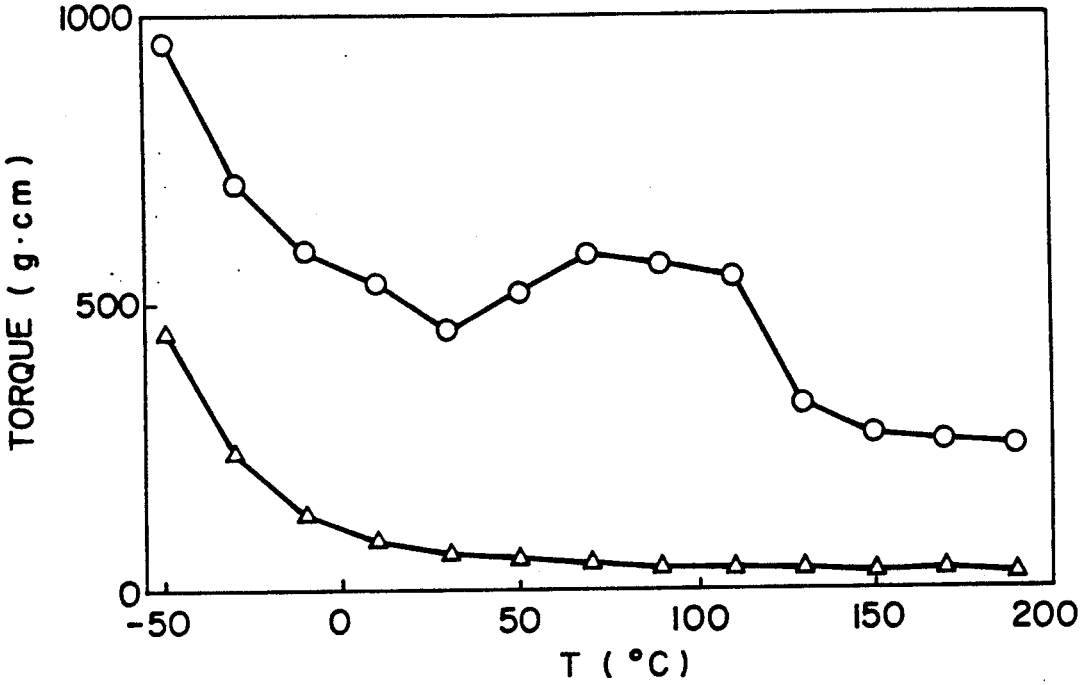
FIG. 3 is a graph showing the relationship between the temperature (abscissa: °C.) and torque (ordinate: g·cm) for the electroviscous fluid of Example 2 when an electric potential difference of 1.5 KV/mm was applied (○ mark) and with no application of the electric potential difference (Δ mark).
Figure 4:
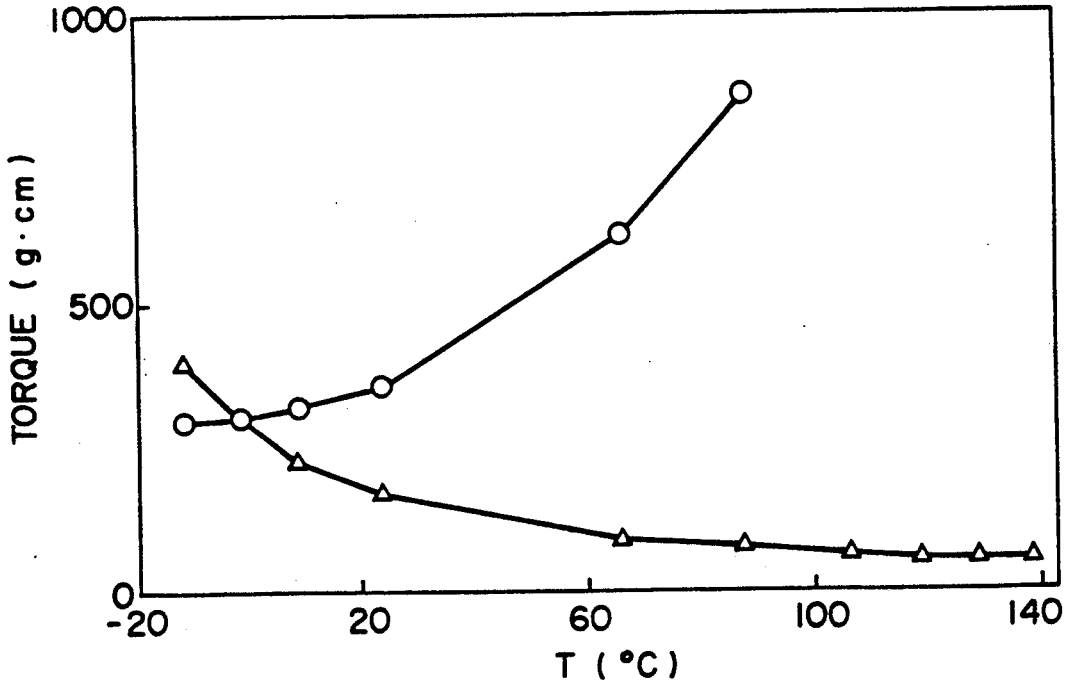
FIG. 4 is a graph showing the result of the same measurement for the electroviscous fluid of Comparative Example 1.

FIG. 3 is a graph showing the relationship between the temperature (abscissa: °C.) and torque (ordinate: g·cm) for the electroviscous fluid of Example 2 when an electric potential difference of 1.5 KV/mm was applied (○ mark) and with no application of the electric potential difference (Δ mark). FIG. 4 is a graph showing the result of the same measurement for the electroviscous fluid of Comparative Example 1.

As can be seen from FIG. 3, the electroviscous fluid of Example 2 can be used from −50° C. to 200° C. Whereas the electroviscous fluid of Comparative Example 1 shows no electroviscous effect under 0° C. as can be seen in FIG. 4, and the electroviscous effect over 90° C. could not be measured because of the need for too much electric current.

We claim:

1. An electroviscous fluid comprising (a) 1–60% by weight of a dispersed phase of carbonaceous particulates having an average particle size of 0.01–100 micrometer, wherein the carbonaceous particulates comprise 80–97% by weight of carbon and a carbon/hydrogen atomic ratio in the range of 1.2–5, and (b) 99–40% by weight of a continuous liquid phase of an electric insulating oil having a viscosity of 0.65–500 centistokes at room temperature.

2. An electroviscous fluid according to claim 1 wherein the carbonaceous particulates are optically anisotropic spherules obtained by heat treatment (at a temperature in the range of 350–500° C.) of coal tar pitch or petroleum pitch and separated from the (residual) pitch component.

3. An electroviscous fluid according to claim 2 wherein the optically anisotropic spherules are those which were calcined at a temperature of 200–600° C.

4. An electroviscous fluid according to claim 1 wherein the carbonaceous particulates are those having an electric insulating thin layer partially or wholly on the surface of each particulate.

5. An electroviscous fluid according to claim 4 wherein the average thickness of the electric insulating thin layer is one tenth or less of the diameter of each particulate.

6. An electroviscous fluid according to claim 4 wherein the electric insulating thin layer is composed of high molecular weight materials, silane coupling agents, modified silicone oils, silicone surface active agents, or inorganic oxides.

7. An electroviscous fluid according to claim 4 wherein the electric insulating thin layer has a volume resistivity of $10^{10}\Omega\cdot$cm or more.

8. An electroviscous fluid according to claim 1 wherein the carbonaceous particulates are those having an aromatic spin radical concentration of $10^{18}$/g or more.

9. An electroviscous fluid according to claim 1 wherein the carbonaceous particulates are those having a volume resistivity of $10^{5}\Omega\cdot$cm or more.

10. An electroviscous fluid according to claim 1 wherein the carbonaceous particulates are those having a water content of less than 1% by weight.

11. An electroviscous fluid according to claim 1 wherein the carbonaceous particulates are pulverized particulates.

12. An electroviscous fluid according to claim 1 wherein the carbonaceous particulates are those obtained by low-temperature carbonization of thermosetting resin.

13. An electroviscous fluid according to claim 1 wherein the electric insulating oil has a volume resistivity of $10^{11}\Omega\cdot$cm or more.

14. An electroviscous fluid according to claim 13 wherein the electric insulating oil is a silicone oil.

* * * * *